US008734122B2

(12) United States Patent
Murray et al.

(10) Patent No.: US 8,734,122 B2
(45) Date of Patent: May 27, 2014

(54) CONTROL AND DIAGNOSTIC SYSTEMS FOR A VARIABLE CAPACITY ENGINE OIL PUMP AND AN ENGINE OIL PRESSURE SENSOR

(75) Inventors: Lawrence O. Murray, White Lake, MI (US); David R. Staley, Flushing, MI (US); Kevin J. Storch, Brighton, MI (US); Colin S. Yager, Pinckney, MI (US); Morena Bruno, Chivasso (IT)

(73) Assignee: GM Global Technology Operations LLC

( * ) Notice: Subject to any disclaimer, the term of this patent is extended or adjusted under 35 U.S.C. 154(b) by 748 days.

(21) Appl. No.: 12/878,284

(22) Filed: Sep. 9, 2010

(65) Prior Publication Data

US 2012/0063927 A1 Mar. 15, 2012

(51) Int. Cl.
*F04B 49/04* (2006.01)

(52) U.S. Cl.
USPC ..... 417/212; 417/14; 123/196 CP

(58) Field of Classification Search
USPC ..... 417/14, 212; 123/196 CP, 196 R, 196 S
See application file for complete search history.

(56) References Cited

U.S. PATENT DOCUMENTS

| | | | | |
|---|---|---|---|---|
| 5,339,776 | A | 8/1994 | Regueiro | |
| 6,317,681 | B2 * | 11/2001 | Elliott et al. | 701/114 |
| 6,758,656 | B2 * | 7/2004 | Maier et al. | 417/203 |
| 6,904,937 | B2 | 6/2005 | Fischer | |
| 7,637,725 | B2 * | 12/2009 | Berger | 418/61.3 |
| 8,499,738 | B2 | 8/2013 | Storch et al. | |
| 2002/0083915 | A1 | 7/2002 | Choi | |
| 2006/0088431 | A1 | 4/2006 | Berger | |
| 2008/0240941 | A1 | 10/2008 | Kumazaki et al. | |
| 2011/0209682 | A1 * | 9/2011 | Storch et al. | 123/196 R |

FOREIGN PATENT DOCUMENTS

| | | |
|---|---|---|
| CN | 1512057 A | 7/2004 |
| JP | 04-017708 | 1/1992 |
| WO | WO-2006066405 A1 | 6/2006 |

* cited by examiner

*Primary Examiner* — Charles Freay
*Assistant Examiner* — Patrick Hamo

(57) ABSTRACT

A control system includes an oil pump module and a diagnostic module. The oil pump module, based on engine operating conditions, selectively generates a first mode request signal to initiate a first transition from operating an oil pump of an engine in one of a first pressure mode and a second pressure mode to operating the oil pump in another one of the first pressure mode and the second pressure mode. The second pressure mode is different from the first pressure mode. The diagnostic module, based on when a driver starts the engine, selectively generates a second mode request signal to initiate consecutive transitions from operating the oil pump in the second pressure mode to operating the oil pump in the first pressure mode. The diagnostic module diagnoses a pump fault when a first oil pressure change associated with the consecutive transitions is less than a first predetermined pressure change.

20 Claims, 9 Drawing Sheets

CONTROL AND DIAGNOSTIC SYSTEMS FOR A VARIABLE CAPACITY ENGINE OIL PUMP AND AN ENGINE OIL PRESSURE SENSOR

FIELD

The present invention relates to oil circulating systems for an internal combustion engine.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An internal combustion engine (ICE) typically includes an oil circulating system. The oil circulating system includes an oil pump that is mechanically connected to a crankshaft of the ICE. This connection assures that the oil pump is circulating oil to and from components of the ICE when the crankshaft is rotating (i.e., engine is operating). Output flow of the oil pump is directly related to the rotating speed of the crankshaft. As the speed of the crankshaft increases, the output flow of the oil pump increases. This general increases oil pressure and provides increased lubrication of the ICE at increased engine speeds.

An engine oil pump introduces drag on an ICE due at least to the mechanical connection on the crankshaft of the ICE. The drag on the crankshaft increases with increased engine speed. Increased drag negatively affects available output torque and fuel economy of the ICE.

An engine oil pump is designed to provide a required flow (i.e., the amount of fluid that flows in a predetermined period) and pressure to adequately lubricate an ICE. The flow and pressure capabilities of the engine oil pump are based on worst case operating conditions. An example of a worst case operating condition is when engine oil is hot (e.g., 250 degrees Fahrenheit (° F.) to 300° F.) and the ICE is operating at high engine speeds (e.g., greater than 3000 revolutions per minute (rpm)).

For this reason, the engine oil pump provides oil flows and pressures that exceed required oil flows and pressures for certain operating states of the ICE. As a non-worst case operating state example, an ICE may have a cool oil temperature (e.g., less than 250° F.) and be operating at a low engine speed. In this operating state, the engine oil pump may provide flow and pressure for the worst case operating condition, which is greater than that required. As a result, unjustified drag on the crankshaft occurs during non-worst case operating states. This decreases available output torque and fuel economy of the ICE.

SUMMARY

A control system includes an oil pump module and a diagnostic module. The oil pump module, based on engine operating conditions, selectively generates a first mode request signal to initiate a first transition from operating an oil pump of an engine in one of a first pressure mode and a second pressure mode to operating the oil pump in another one of the first pressure mode and the second pressure mode. The second pressure mode is different from the first pressure mode. The diagnostic module, based on when a driver starts the engine, selectively generates a second mode request signal to initiate consecutive transitions from operating the oil pump in the second pressure mode to operating the oil pump in the first pressure mode. The diagnostic module diagnoses a pump fault when a first oil pressure change associated with the consecutive transitions is less than a first predetermined pressure change.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
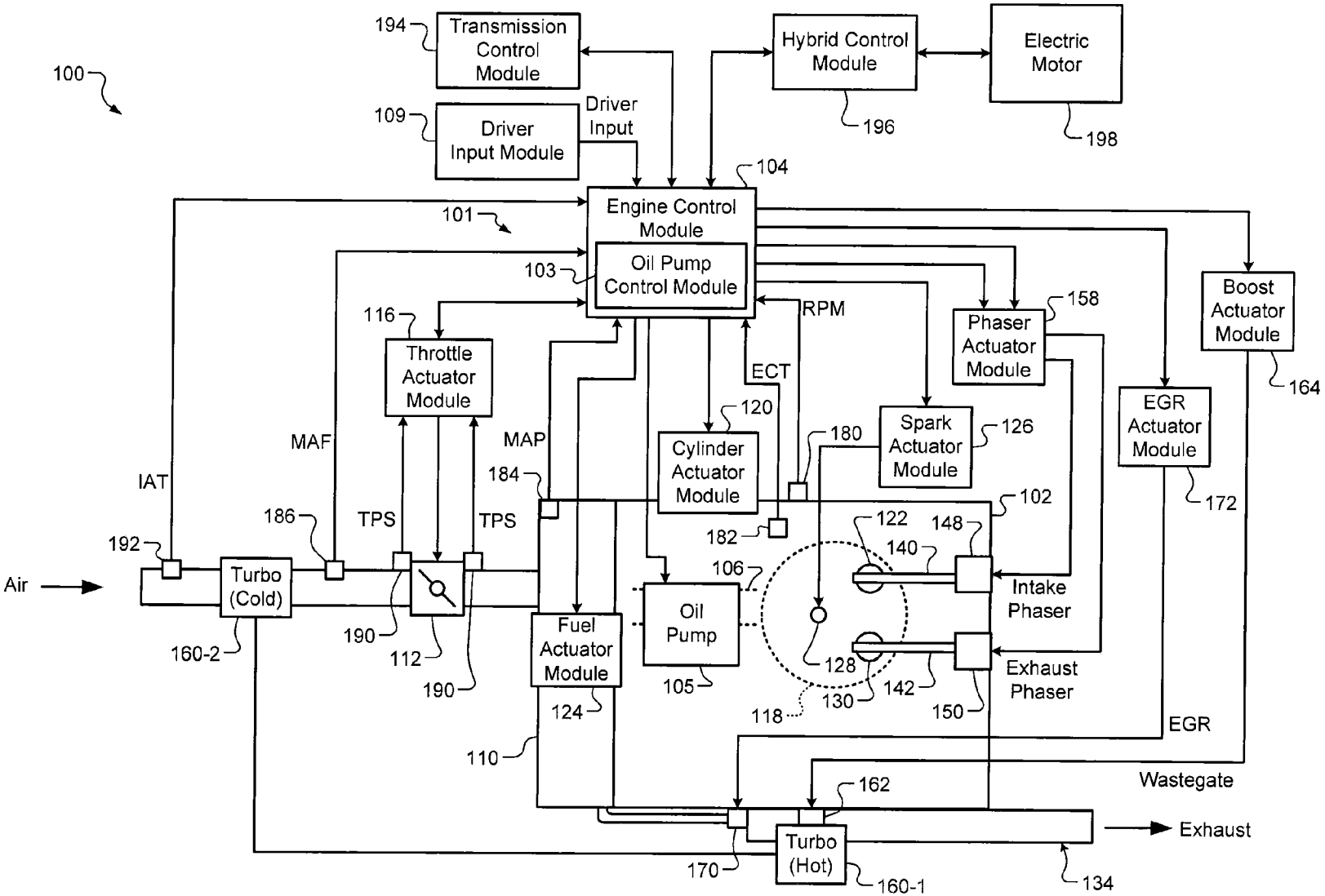
FIG. 1 is a functional block diagram of an engine control system incorporating an oil circulating control system in accordance with the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

Traditionally, an oil pump of an engine is designed for a worst case operating condition. As a result, the oil pump provides a minimum flow and pressure that is required for the worst case operating condition. During all other operating conditions, the pump may provide an excess of flow and pressure. This negatively affects the available torque output and the fuel economy of the engine.

Control and diagnostic systems are disclosed herein for a variable displacement (switchable) oil pump of an engine. Active control of a variable displacement pump allows for selection of different flows and pressures (e.g., high and low pressures) for the same engine speed. This increases fuel economy and available engine output torque while meeting and/or exceeding lubrication requirements of an engine.

Conventional control systems operate a variable displacement pump in a low flow position under most conditions to improve fuel economy. The variable displacement pump is only switched to a high flow position during worst case operating conditions, such as at idle speed when engine oil is hot or during hard accelerations and decelerations, at high speeds and/or under high loads. Pressure differences due to switching a variable displacement pump are difficult to detect when an engine is operating at idle speed since the output pressure of the pump does not change significantly. Pressure differences due to switching a variable displacement pump during hard accelerations or decelerations may be masked by pressure changes due to engine speed changes. Thus, conventional diagnostic systems are unable to reliably detect when a variable displacement pump does not switch positions as commanded in certain operating conditions.

Control and diagnostic systems are disclosed herein for detecting whether a variable displacement pump switches states as commanded. An active test actively controls the variable displacement pump to consecutively switch states at steady state engine speeds greater than idle speed, and detects when the pump does not switch states as commanded. A passive test passively monitors operating conditions while the variable displacement pump switches states and detects when the pump does not switch states as commanded. The active test is initially executed when an engine is started, and the passive test is executed when the active test detects that the variable displacement pump is switching states as commanded. The passive test retriggers the active test when the passive test detects that the variable displacement pump is not switching states as commanded.

Actively controlling and evaluating a variable displacement pump at steady state speeds greater than idle speed enables reliable diagnosis of a faulty variable displacement pump. Passively evaluating a variable displacement pump after the active test ensures detection of failures occurring after the active test has been executed. Retriggering the active test when the passive test detects that the variable displacement pump is not switching as commanded rather than diagnosing a faulty pump prevents a false diagnosis. Such a false diagnosis may otherwise occur in operating conditions that increase the difficulty of detecting when the variable displacement pump switches.

Figure 2:
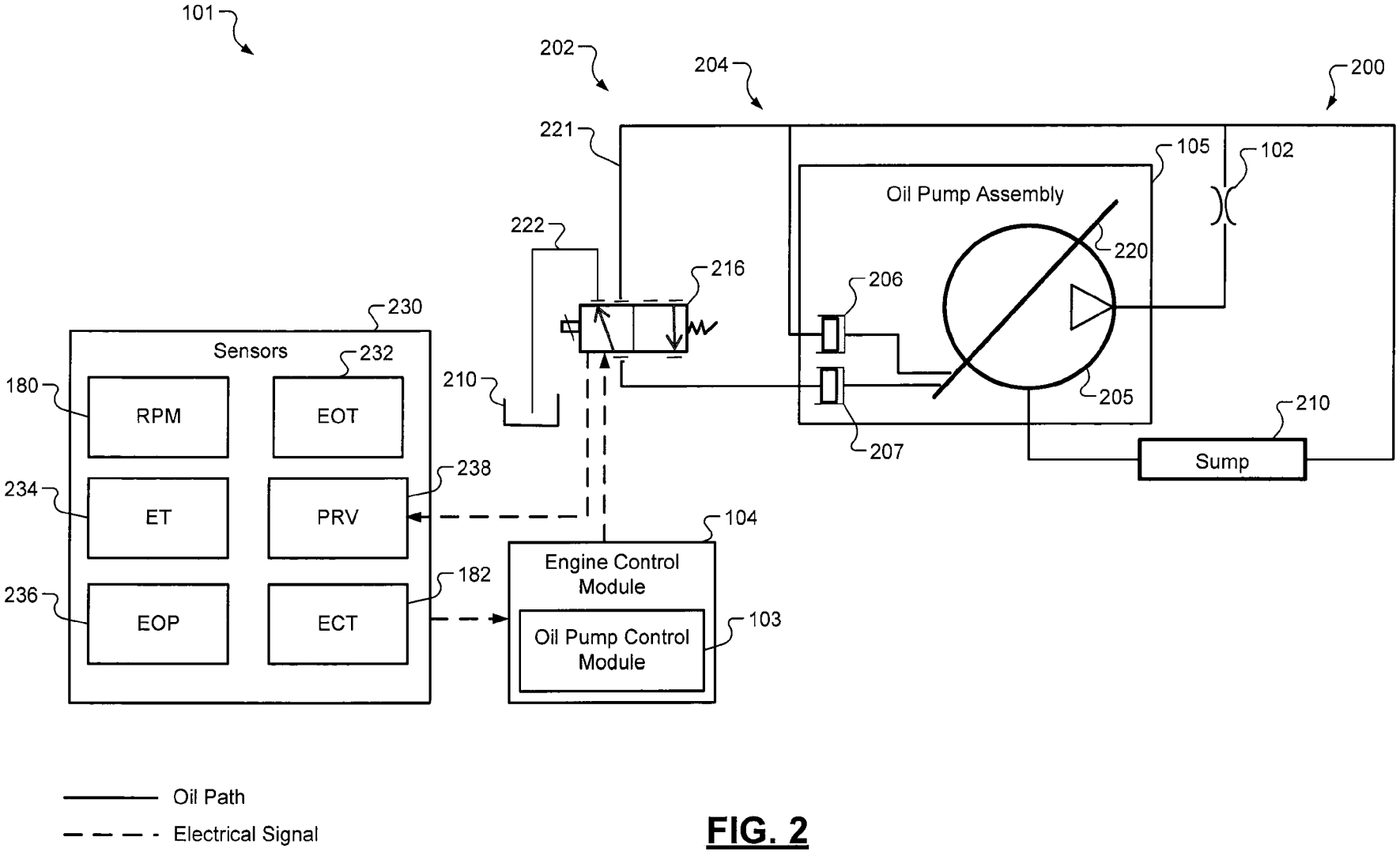
FIG. 2 is a functional block diagram of the oil circulating control system in accordance with the present disclosure.

In FIG. 1, a functional block diagram of an exemplary engine control system 100 is shown. The engine control system 100 includes an oil circulating control system 101 that controls circulation of oil to and from components of an engine 102. The oil circulating control system 101 includes an oil pump control module 103, which may be included as part of an engine control module (ECM) 104. The oil pump control module 103 controls operation of a multiple and/or variable displacement oil pump. An oil pump assembly 105 draws oil from a sump (e.g., oil pan) and directs oil to components (e.g., valves, cylinders, camshafts, etc.) of the engine 102. An example sump is shown in FIG. 2.

The oil pump assembly 105 is mechanically connected to a crankshaft 106 of the engine 102. The oil pump assembly 105 may be a vane pump and/or gear pump. Oil flow and pressure output of the oil pump assembly 105 is directly related to the rotating speed of the crankshaft 106 and is based on a control signal generated by the oil pump control module 103. The oil pump assembly 105 may be located in a sump (e.g., oil pan) or elsewhere on the engine 102.

The oil pump assembly 105 may have multiple pressure modes for a given engine speed. The pressure modes are selected via the oil pump control module 103. For example, the oil pump assembly 105 may have a first pressure mode and a second pressure mode. The first pressure mode may be a high-pressure (e.g., 3-5.5 kilopascals (kPa)) mode and the second pressure mode may be a low-pressure (e.g., 2-3 kPa) mode. The first pressure mode may be associated with engine speeds greater than a first predetermined threshold or engine speed. The second pressure mode may be associated with engine speeds less than or equal to the first predetermined engine speed. The oil pump may have any number of pressure modes for any engine speed.

The engine 102 combusts an air/fuel mixture to produce drive torque for a vehicle based on driver input from a driver input module 109. Air is drawn into an intake manifold 110 through a throttle valve 112. For example, the throttle valve 112 may include a butterfly valve having a rotatable blade. The ECM 104 controls a throttle actuator module 116, which regulates opening of the throttle valve 112 to control the amount of air drawn into the intake manifold 110.

Air from the intake manifold 110 is drawn into cylinders of the engine 102. While the engine 102 may include any number of cylinders, for illustration purposes a single representative cylinder 118 is shown. The ECM 104 may instruct a cylinder actuator module 120 to selectively deactivate some of the cylinders under certain engine operating conditions.

The engine 102 may operate using a four-stroke cycle. The four strokes, described below, are named the intake stroke, the compression stroke, the combustion stroke, and the exhaust stroke. During each revolution of the crankshaft 106, two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 104 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 in the cylinder 118 based on a signal from the ECM 104, which ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

During the combustion stroke, the combustion of the air/fuel mixture drives the piston down, thereby driving the crankshaft 106. The combustion stroke may be defined as the time between the piston reaching TDC and the time at which the piston returns to bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140. The exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The time at which the intake valve 122 is opened may be varied with respect to piston TDC by an intake cam phaser 148. The time at which the exhaust valve 130 is opened may be varied with respect to piston TDC by an exhaust cam phaser 150. A phaser actuator module 158 may control the intake cam phaser 148 and the exhaust cam phaser 150 based on signals from the ECM 104.

The engine system 100 may include a boost device that provides pressurized air to the intake manifold 110. For example, FIG. 1 shows a turbocharger including a hot turbine 160-1 that is powered by hot exhaust gases flowing through the exhaust system 134. The turbocharger also includes a cold air compressor 160-2, driven by the turbine 160-1, which compresses air leading into the throttle valve 112. In various implementations, a supercharger (not shown), driven by the crankshaft 106, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 104 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

The engine system 100 includes various sensors. The engine system 100 may include an engine speed sensor 180 that is used to detect speed of the crankshaft 106 in revolutions per minute (rpm). The temperature of the engine coolant may be measured using an engine coolant temperature (ECT) sensor 182. The ECT sensor 182 may be located within the engine 102 or at other locations where the coolant is circulated, such as in a radiator (not shown).

The pressure within the intake manifold 110 may be measured using a manifold absolute pressure (MAP) sensor 184. In various implementations, engine vacuum, which is the difference between ambient air pressure and the pressure within the intake manifold 110, may be measured. The mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 102 may be measured using an intake air temperature (IAT) sensor 192. The ECM 104 may use signals from the sensors to make control decisions for the engine system 100. Additional sensors are disclosed and described with respect to FIGS. 2-4.

The ECM 104 may communicate with a transmission control module 194 to coordinate shifting gears in a transmission (not shown). For example, the ECM 104 may reduce engine torque during a gear shift. The ECM 104 may communicate with a hybrid control module 196 to coordinate operation of the engine 102 and an electric motor 198.

The electric motor 198 may also function as a generator, and may be used to produce electrical energy for use by vehicle electrical systems and/or for storage in a battery. In various implementations, various functions of the ECM 104, the transmission control module 194, and the hybrid control module 196 may be integrated into one or more modules.

Each system that varies an engine parameter may be referred to as an actuator that receives an actuator value. For example, the throttle actuator module 116 may be referred to as an actuator and the throttle opening area may be referred to as the actuator value. In the example of FIG. 1, the throttle actuator module 116 achieves the throttle opening area by adjusting an angle of the blade of the throttle valve 112.

Similarly, the spark actuator module 126 may be referred to as an actuator, while the corresponding actuator value may be the amount of spark advance relative to cylinder TDC. Other actuators may include the cylinder actuator module 120, the fuel actuator module 124, the phaser actuator module 158, the boost actuator module 164, and the EGR actuator module 172. For these actuators, the actuator values may correspond to number of activated cylinders, fueling rate, intake and exhaust cam phaser angles, boost pressure, and EGR valve opening area, respectively. The ECM 104 may control actuator values in order to cause the engine 102 to generate a desired engine output torque.

Referring now also to FIG. 2, the oil circulating control system 101 is shown. Solid lines between devices refer to oil lines or paths. Dashed lines between devices refer to electrical signal lines. The oil circulating control system 101 includes an engine lubrication circuit 200, a variable oil pressure control circuit 202, and a pressure regulating circuit 204. Each of the circuits 200-206 includes the oil pump control module 103, the ECM 104, the oil pump assembly 105 and a sump (e.g., oil pan) 210. The oil pump assembly includes a variable displacement oil pump ("oil pump") 205, a primary chamber 206, and a secondary chamber 207.

The engine lubrication circuit 200 provides oil to and lubricates the engine 102. In operation, engine oil in the sump 210 is drawn to the oil pump assembly 105, where it is pressurized, and directed to the engine 102. The engine oil is directed from the engine 102 back to the sump 210.

The variable oil pressure control circuit 202 is used to provide two or more possible oil pressures to the engine 102 for each speed of the engine 102. The variable oil pressure control circuit 202 includes a solenoid valve 216. The oil pump control module 103 may signal the solenoid valve 216 via a relay (not shown). The solenoid valve 216 has multiple positions, which are selectable based on a control signal from the oil pump control module 103. The solenoid valve 216 may have any number of valve positions and may be connected between the engine 102 and the oil pump assembly 105 or anywhere within the lubrication circuit 200. An oil pressure signal is provided via the lubrication circuit 200 either upstream or downstream of an oil filter (not shown) to control displacement of the oil pump 205.

The oil pump 205 may include a cam ring represented by line 220 that provides a lever function. Displacement of the oil pump 205 is directly proportional to a straight line distance between a drive center of the oil pump 205 and a center of the cam ring 220. The pressures in the primary and secondary chambers 206, 207 act on and cause the cam ring 220 to pivot (the lever function). The center of the cam ring 220 is rotated closer to the drive center of the oil pump 205 when the cam ring 220 is pivoted. In doing so, displacement of the oil pump 205 is reduced, which reduces oil flow output and thus regulates oil pressure. At all times, speed of the oil pump 205 is maintained at crankshaft speed or at a constant proportional value of the crankshaft speed.

Oil from the solenoid valve 216 may be directed to the secondary chamber 207 to adjust pressure on the cam ring 220. This adjusts flow and output pressure of the oil pump 205. As one example, the solenoid valve 216 may have a first position and a second position. The first position corresponds to the first pressure mode and the second position corresponds with the second pressure mode. In one embodiment, the first position is associated with atmospheric pressure or pressure within the crankcase of the engine 102. The solenoid valve may not be energized when in the first position. The second position is associated with an oil pressure received from the engine 102 or line pressure, such as pressure within the oil line 221. Oil pressure of the oil pump 205 decreases when the solenoid valve is placed in the second position relative to the first position. This decreases oil pressure within the engine 102 and oil pressure supplied to the primary chamber 206. As another example, the solenoid valve 216 may include a fully closed position and a fully open position and may also have any number of positions between the fully closed position and the fully open position.

The solenoid valve 216 may have a vent output 222 to the sump 210. This may be used to adjust oil flow and/or pressure from the solenoid valve 216 to the oil pump assembly 105. The vent output 222 may also be used to limit pressure of oil to the oil pump assembly 105 from the solenoid valve 216.

Operation of the solenoid valve 216 is controlled by the oil pump control module 103 based on engine operating parameters. The engine operating parameters may be determined based on signals from various sensors 230. The sensors 230 may include the engine speed sensor 180, an engine oil temperature (EOT) sensor 232, an engine torque (ET) sensor 234, an engine oil pressure (EOP) sensor 236, and a powertrain relay voltage (PRV) sensor 238. Engine parameters may be indirectly determined via corresponding algorithms instead of directly from sensors. For example, the ECM 104 may indirectly determine engine oil temperature via a corresponding algorithm based on engine operating conditions and ambient conditions rather than directly from an EOT sensor.

The engine torque sensor 234 may be used to directly detect engine output torque. In addition to or as an alternative, the engine output torque may be estimated by an engine torque module 240 (shown in FIG. 3). The powertrain relay voltage sensor 238 may be used to detect voltage of the solenoid valve 216. This voltage may be the voltage of the control signal provided from the oil pump control module 103.

The pressure regulating circuit 204 returns an oil pressure signal via the lubrication circuit 200 back to the oil pump assembly 105 to regulate pressure output of the oil pump 205. The oil pressure signal returned to the oil pump assembly 105 may be received in the primary chamber 206. Pressure within the primary chamber 206 adjusts engagement of the lever 220, which in turn affects pressure output of the oil pump 205.

Figure 3:
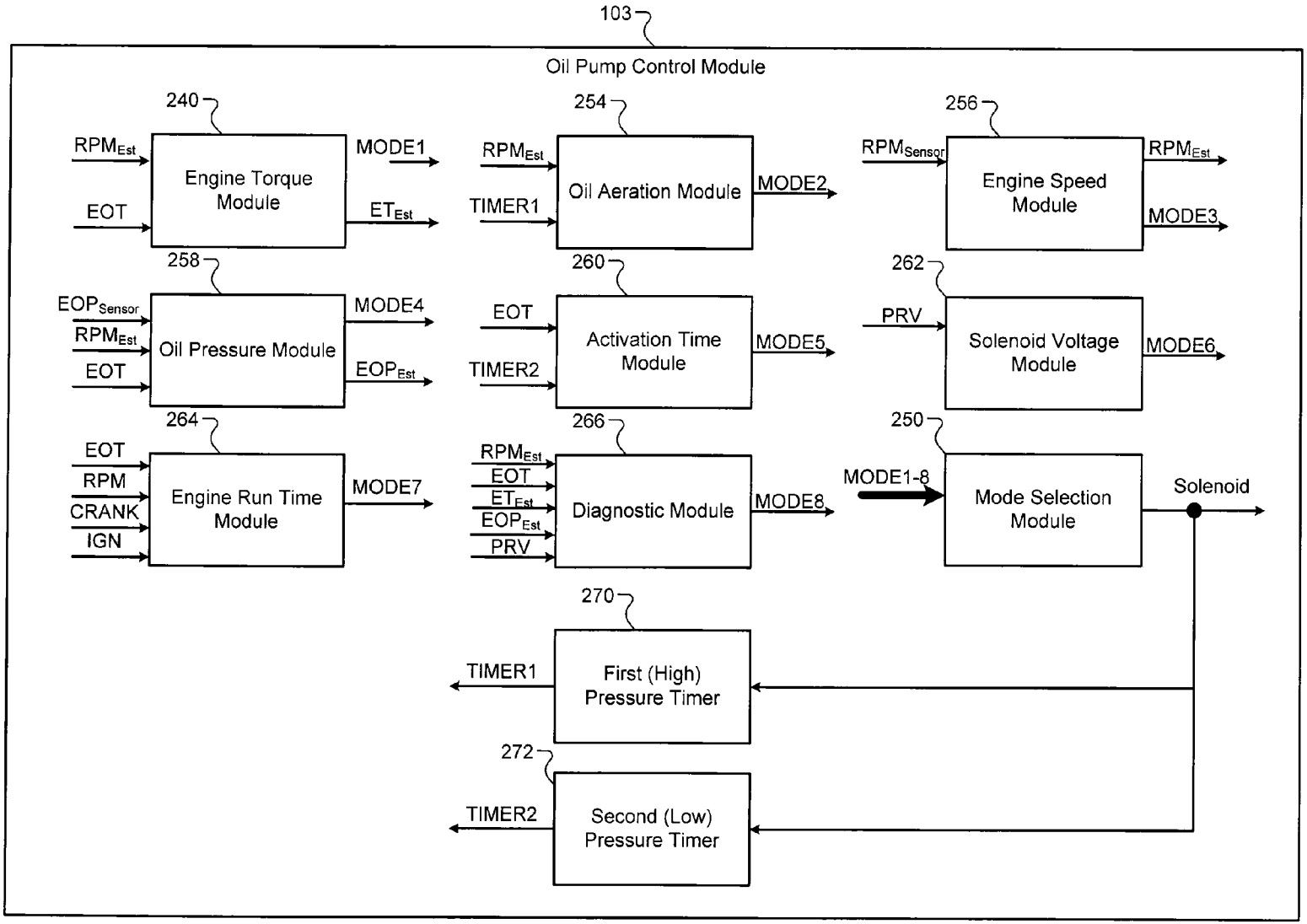
FIG. 3 is a functional block diagram of an oil pump control module in accordance with the present disclosure.
Figure 4:
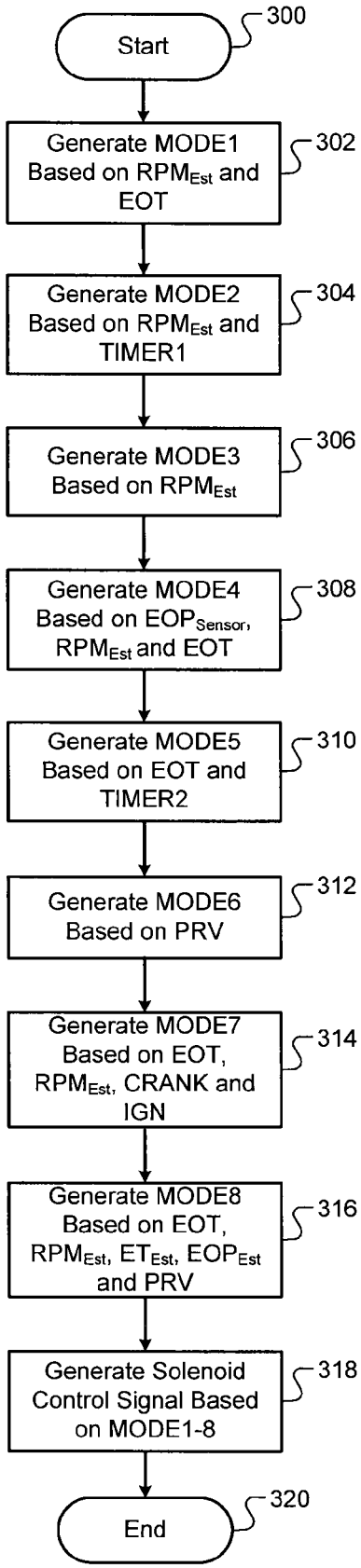
FIG. 4 illustrates a method of controlling an oil circulating control system in accordance with the present disclosure.
Figure 5:
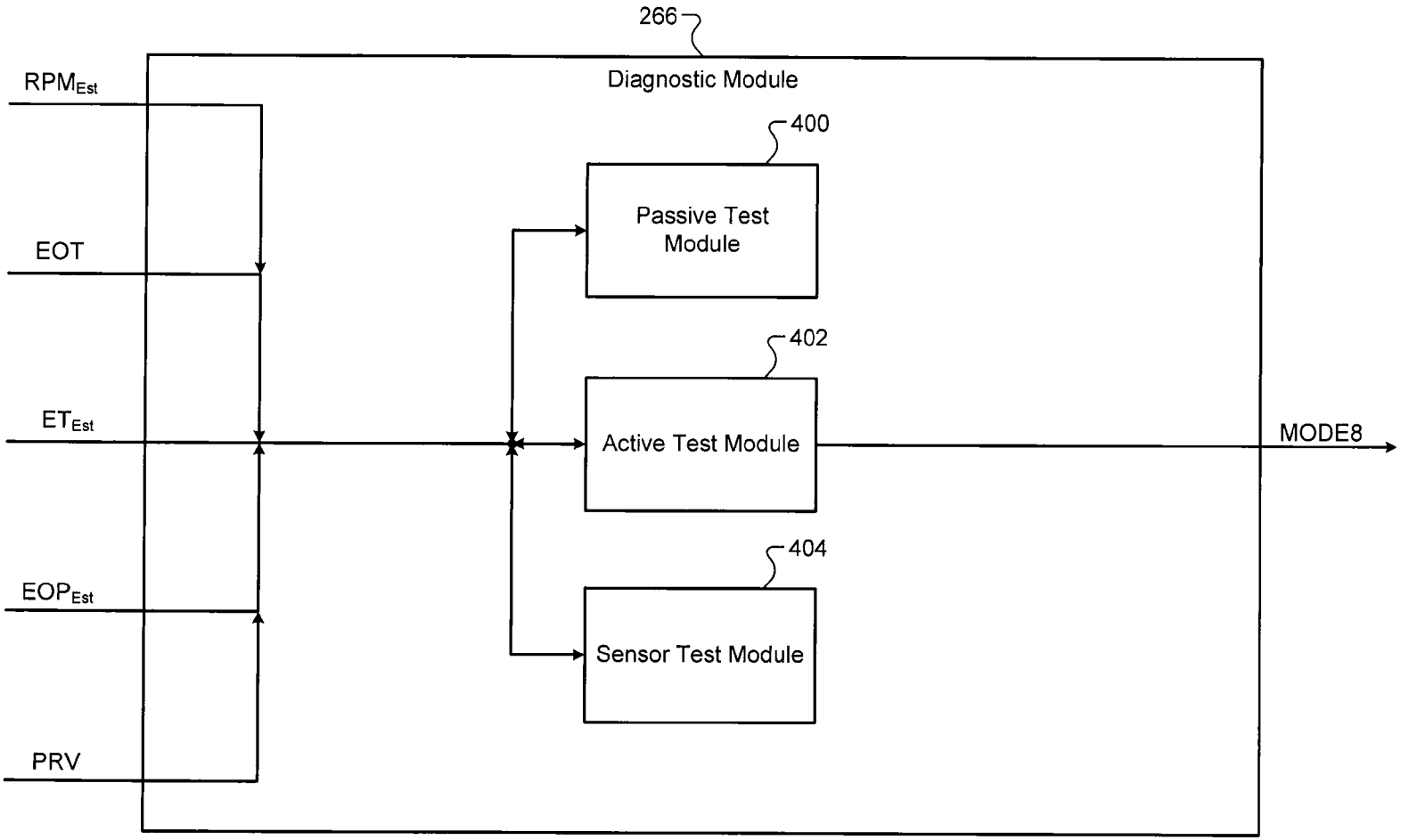
FIG. 5 is a functional block diagram of a diagnostic module in accordance with the present disclosure.

Referring now also to FIGS. 3 and 4, the oil pump control module 103 and a method of operating the oil circulating control system 101 are shown. The oil pump control module 103 includes the engine torque module 240, a mode selection module 250, an oil aeration module 254, an engine speed module 256, an oil pressure module 258, an activation time module 260, a solenoid voltage module 262, an engine run time module 264, and a diagnostic module 266 (collectively referred to as oil pump modules).

The mode selection module 250 generates a solenoid valve control signal based on outputs of the modules 240 and 254-266. In one example embodiment, the solenoid valve control signal has a first state and a second state. The first state corresponds to the first (high) pressure mode and the second state corresponds to the second (low) pressure mode. In another example embodiment, the solenoid valve control signal is a pulse width modulated signal that is used to control the solenoid valve to position the valve in one of two or more positions.

Although the following tasks are primarily described with respect to the embodiments of FIGS. 1-3, the tasks may be performed apart from these embodiments in accordance with the present disclosure. Also, although the following tasks are described primarily with respect to the first and second pressure modes, the tasks may be performed using additional pressure modes. The method begins at 300.

At 302, the engine torque module 240 may estimate torque output of the engine 102 and generate an estimated engine torque output signal $ET_{Est}$. The engine torque module 240 generates a first mode request signal MODE1 based on the engine torque output signal $ET_{Est}$, a speed of the engine (e.g., speed of the crankshaft) $RPM_{Est}$, and/or oil temperature of the engine EOT. Although the modes of FIG. 4 are shown as being performed sequentially, two or more of the modes may be performed during the same period.

As one example, the first mode request signal MODE1 may be set, for example, HIGH, when the engine torque increases to a torque level that is greater than a predetermined torque for a given engine speed. This indicates that the engine torque module 240 is requesting a transition from the second (low) pressure mode to the first (high) pressure mode. The predetermined torque level may be offset based on the oil temperature of the engine EOT.

As another example, a first value V1 may be determined using equation 1.

$$V1 = f\{ET, RPM, EOT\} \quad (1)$$

The first mode request signal MODE1 may be set HIGH when the first value V1 is greater than a first predetermined level.

As yet another example, a second value V2 may be determined using equation 2, where K is a constant.

$$V2=f\{ET,RPM\}-K\cdot EOT \quad (2)$$

The first mode request signal MODE1 may be set HIGH when the second value V2 is greater than a second predetermined level. The mode selection module 250 may set the first mode request signal MODE1 LOW when the engine torque decreases to the predetermined torque and/or when one of the values V1, V2 is less than or equal to the corresponding predetermined level.

At 304, the oil aeration module 254 generates a second mode request signal MODE2 based on the engine speed $RPM_{Est}$ and time that the oil pump assembly 105 is operating in the first (high) pressure mode. The oil aeration module 254 may receive a first timer signal TIMER1 from a first (high) pressure timer 270. The first pressure timer 270 monitors time that the oil pump assembly 105 is operating in the first pressure mode. The first pressure timer 270 may generate the first timer signal TIMER1 based on the solenoid valve control signal received from the mode selection module 250.

The oil aeration module 254 may set the second mode request signal MODE2 to, for example, LOW when the first timer signal TIMER1 is greater than a first predetermined time. This indicates that the oil aeration module 254 is requesting a transition from the first (high) pressure mode to the second (low) pressure mode. This reduces aeration and improves effectiveness of the engine oil. This limits the amount of time that the oil pump assembly 105 is operating in the first (high) pressure mode.

The oil aeration module 254 may set the second mode request signal MODE2 to, for example, HIGH when the speed of the engine 102 is greater than a first predetermined speed and/or when the first timer signal TIMER1 is less than or equal to the first predetermined time.

At 306, the engine speed module 256 determines the engine speed $RPM_{Est}$ based on the engine speed signal $RPM_{Sensor}$ received from the engine speed sensor 180. The engine speed module 256 generates a third mode request signal MODE3 based on the engine speed $RPM_{Est}$. The third mode request signal MODE3 may be set, for example, HIGH when the engine speed is increased to a speed that is greater than a second predetermined speed (e.g., 3000 rpm). This indicates that the engine speed module 256 is requesting a transition from the second (low) pressure mode to the first (high) pressure mode. The third mode request signal MODE3 may be set LOW when the engine speed is decreased to a speed that is less than a third predetermined speed (e.g., 2800 rpm). The second and third predetermined speeds may be equal to or different than the first predetermined speed. The second and third predetermined speeds may be different than the first predetermined speed to provide hysteresis. Hysteresis prevents toggling between pressure modes multiple times within a predetermined period.

At 308, the oil pressure module 258 determines oil pressure of the engine $EOP_{Est}$ and generates a fourth mode request signal MODE4. The oil pressure may be determined based on an oil pressure signal $EOP_{Sensor}$ from the oil pressure sensor 236. The fourth mode request signal MODE4 may be set, for example, HIGH when the oil pressure is less than a first predetermined, oil pressure. The fourth mode request signal MODE4 may be set, for example, LOW when the oil pressure $EOP_{Est}$ is greater than a second predetermined oil pressure. The second predetermined oil pressure is greater than the first predetermined oil pressure to provide hysteresis.

At 310, the activation time module 260 generates a fifth mode request signal MODE5 based on oil temperature of the engine 102 and time that the oil pump assembly 105 is operating in the second (low) pressure mode. The activation time module 260 may receive a second timer signal TIMER2 from a second (low) pressure timer 272. The second pressure timer 272 may generate the second timer signal TIMER2 based on the solenoid valve control signal.

The activation time module 260 may set the fifth mode request signal MODE5, for example, HIGH when the engine oil temperature EOT is greater than a first predetermined temperature and/or when the second timer signal TIMER2 is greater than a second predetermined time. This limits the amount of time that the oil pump assembly 105 is operating in the second (low) pressure mode. The activation time module 260 may set the fifth mode request signal MODE5 LOW when the engine oil temperature EOT is less than a second predetermined temperature and/or when the second timer signal TIMER 2 is less than or equal to the second predetermined time. The second predetermined temperature may be less than the first predetermined temperature to provide hysteresis.

At 312, the solenoid voltage module 262 generates a sixth mode request signal MODE6 based on powertrain solenoid voltage PRV of the solenoid valve. The solenoid voltage module 262 may set the sixth mode request signal MODE6, for example, HIGH when the powertrain solenoid voltage PRV is less than a first predetermined voltage. This indicates a request to transition from the second (low) pressure mode to the first (high) pressure mode. The solenoid voltage module 262 may set the sixth mode request signal MODE6 LOW when the powertrain solenoid voltage PRV is greater than a second predetermined voltage. The second predetermined voltage is greater than the first predetermined voltage to provide hysteresis.

At 314, the engine run time module 264 generates a seventh mode request signal MODE7 based on the engine oil temperature EOT and run time of the engine ERT. The engine run time module 264 may determine the engine run time based on, for example, the speed of the engine $RPM_{Est}$, a crank signal of the engine CRANK, and/or an ignition signal of the engine 102. The run time of the engine 102 indicates the length of time that the engine 102 is operating at a speed greater than a predetermined speed or 0 rpm.

The engine run time module 264 may set the seventh mode request signal MODE7 to, for example, HIGH when the engine oil temperature EOT is greater than or equal to a third predetermined temperature and/or when the engine run time is less than or equal to a third predetermined time (e.g., 10 seconds). This causes the oil pump assembly 105 to initially operate in the first (high) pressure mode upon startup of the engine 102 for at least the predetermined period (engine prime period). This also allows oil pressure to quickly increase and oil to be provided to components of the engine 102 quickly upon startup. The engine run time module 264 may set the seventh mode request signal MODE7 to, for example, LOW when the engine oil temperature EOT is less than the third predetermined temperature and/or when the engine run time is greater than the third predetermined time.

At 316, the diagnostic module 266 generates an eighth mode request signal MODE8 based on the engine speed $RPM_{Est}$, engine oil temperature EOT, engine oil pressure $EOP_{Est}$, torque output $ET_{Est}$, and powertrain solenoid voltage PRV. The diagnostic module 266 selectively diagnoses a fault in the oil circulating control system 101 based on operating conditions. These operating conditions may include the engine speed $RPM_{Est}$, the engine oil temperature EOT, the engine oil pressure $EOP_{Est}$, the torque output $ET_{Est}$, and/or the powertrain solenoid voltage PRV. The diagnostic module 266 may set the eighth mode request signal MODE8, for example, HIGH when a fault is diagnosed. This requests the first (high) pressure mode.

At 318, the mode selection module 250 generates the solenoid valve control signal based on at least one of the first, second, third, fourth, fifth, sixth, seventh, and eighth mode request signals (mode request signals MODE1-8). The mode selection module 250 may generate the solenoid valve control signal based on any combination of the mode request signals MODE1-8.

As one example, the mode selection module 250 may include an eight input AND gate that receives the eight mode request signals. The output of the AND gate may be HIGH when all of the eight mode request signals MODE1-8 are HIGH. The solenoid valve 216 may be positioned in the first position associated with the high-pressure mode when the output of the mode selection module 250 is HIGH. The solenoid valve 216 may be positioned in the second position associated with the low-pressure mode when the output of the mode selection module 250 is LOW.

As another example, the mode selection module 250 may generate the solenoid valve control signal base on a hierarchy of the modules 240 and 254-266 and/or a hierarchy of the eight mode request signals MODE1-8. A hierarchy refers to a priority ranking of modules and/or signals.

For example, the mode selection module 250 may set the solenoid valve control signal to HIGH when the eighth mode request signal MODE8 is HIGH regardless of the state of one or more of the mode request signals MODE1-7.

As yet another example, the mode selection module 250 may prevent transitioning from the first (high) pressure mode to the second (low) pressure mode when the second mode request signal is LOW. The mode selection module 250 may prevent transitioning until the third mode request signal MODE 3 is LOW (i.e., the engine speed is less than the first and/or second predetermined speeds). The method may end at 320.

The above-described tasks 300-320 are meant to be illustrative examples; the tasks 300-320 may be performed sequentially or nonsequentially, synchronously or nonsychronously, simultaneously or nonsimultaneously, continuously or noncontinuously, during overlapping time periods or in a different order depending upon the application.

Referring now also to FIGS. 5-9, the diagnostic module 266 and methods of diagnosing a fault in the oil circulating control system 101 are shown. The diagnostic module 266 includes an active test module 400, a passive test module 402, and a sensor test module 404. Each of these modules receives the engine speed $RPM_{Est}$, the engine oil temperature EOT, the engine oil pressure $EOP_{Est}$, the torque output $ET_{Est}$, and/or the powertrain solenoid voltage PRV.

The active and passive test modules 400, 402 execute active and passive tests, respectively, to evaluate the oil pump assembly 105. The sensor test module 404 executes a sensor test to evaluate the oil pressure sensor 236. The active test module 400 selectively cycles the oil pump assembly 105 between the first (high) pressure mode and the second (low) pressure mode and selectively diagnoses a pump fault based on the engine oil pressure $EOP_{Est}$. The passive test module 402 selectively initiates the active test based on the engine oil pressure $EOP_{Est}$ as the oil pump assembly 105 is cycled by oil pump modules other than the diagnostic module 266. The sensor test module 404 selectively diagnoses a sensor fault based on the engine oil pressure $EOP_{Est}$.

Figure 6:
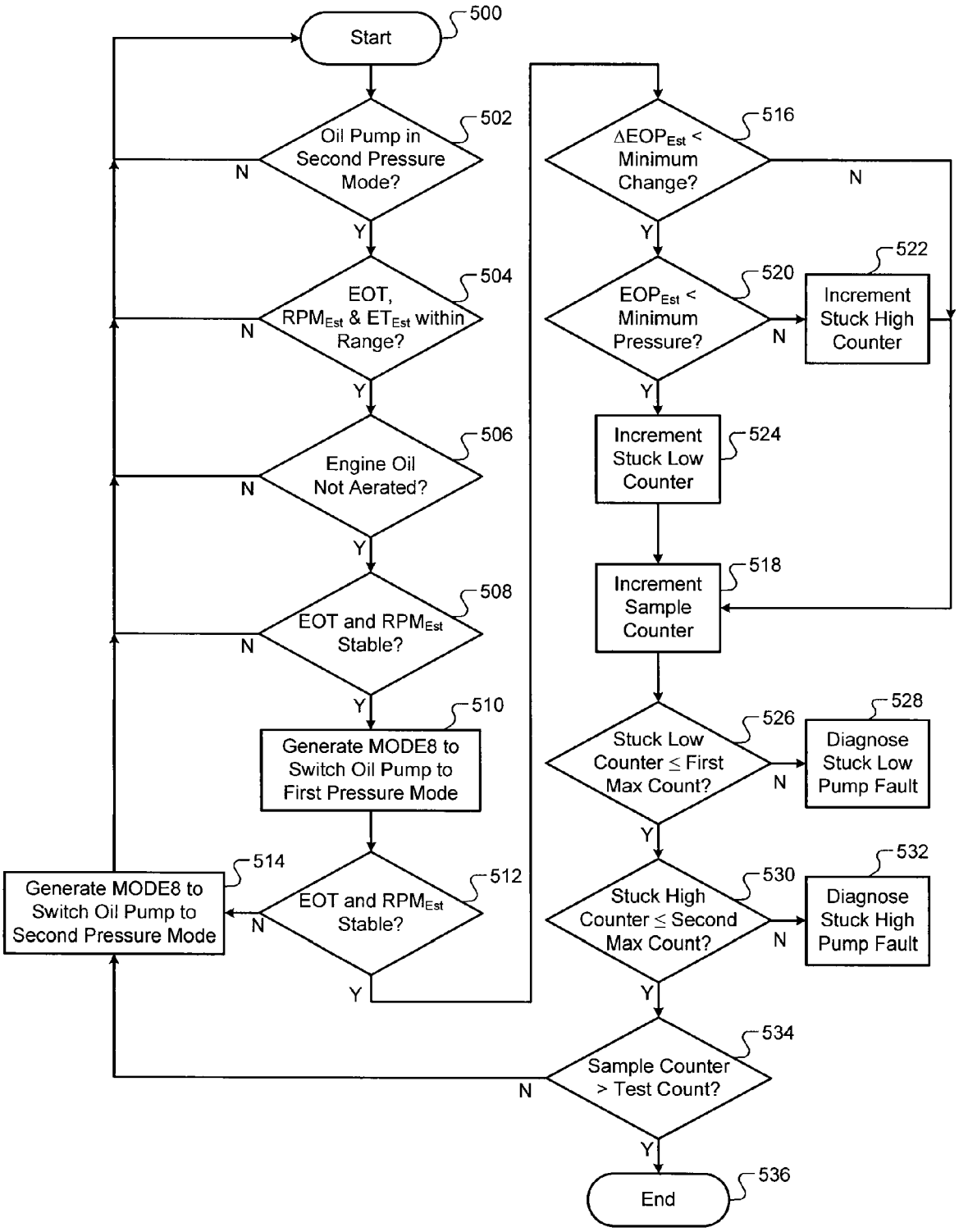
FIGS. 6 through 9 illustrate methods of diagnosing faults in an oil pump and an oil pressure sensor in accordance with the present disclosure.

Although the following tasks are primarily described with respect to the embodiments of FIGS. 1-5, the tasks may be performed apart from these embodiments in accordance with the present disclosure. Also, although the following tasks are described primarily with respect to the first and second pressure modes, the tasks may be performed using additional pressure modes. The active test module 400 begins the active test at 500 (FIG. 6).

At 502, the active test module 400 determines whether the oil pump assembly 105 is operating in the second (low) pressure mode. The active test module 400 may make this determination based on, for example, the solenoid valve control signal generated by the mode selection module 250. In addition, the active test module 400 may make this determination based on the engine oil pressure $EOP_{Est}$. If 502 is false, the active test module 400 continues at 500. If 502 is true, the active test module 400 continues at 504.

The oil pump assembly 105 may be operated in the first (high) pressure mode to satisfy lubrication requirements of the engine 102 that may not be satisfied when the oil pump assembly 105 is operated in the second (low) pressure mode. Thus, the active test module 400 may make the determination at 502 to refrain from cycling the oil pump assembly 105 when the oil pump assembly 105 is initially operating in the first (high) pressure mode.

At 504, the active test module 400 determines whether the engine speed $RPM_{Est}$, the engine oil temperature EOT, and the torque output $ET_{Est}$ are within predetermined ranges. The predetermined ranges enable identifying the operating mode of the oil pump assembly 105 based on the engine oil pressure $EOP_{Est}$, ensuring that the lubrication requirements of the engine 102 are satisfied, and avoiding a torque change that may be felt by a driver. The predetermined ranges for the engine speed $RPM_{Est}$, the engine oil temperature EOT, and the torque output $ET_{Est}$ may be determined via laboratory and/or vehicle testing based on the preceding test considerations.

The engine oil pressure $EOP_{Est}$ is a function of the engine speed $RPM_{Est}$, the engine oil temperature EOT, oil viscosity, and oil pump volume. The predetermined speed and temperature ranges may provide boundaries within which the relationships between these parameters may be defined.

In another example, for a given engine speed $RPM_{Est}$, the engine oil pressure $EOP_{Est}$ is linearly related to the engine oil temperature EOT other than when the engine oil temperature EOT is low or high. Thus, a first predetermined temperature may define an upper boundary of low engine oil temperatures and a second predetermined temperature may define a lower boundary of high engine oil temperatures. In turn, the engine oil pressure $EOP_{Est}$ may be linearly related to the engine oil temperature EOT when the engine oil temperature EOT is greater than the first predetermined temperature and less than the second predetermined temperature.

In yet another example, for a given engine oil temperature EOT, the engine oil pressure $EOP_{Est}$ increases proportionally to a square of the engine speed $RPM_{Est}$ other than when the engine speed $RPM_{Est}$ is low or high. Thus, a first predetermined speed may define an upper boundary of low engine speeds and a second predetermined speed may define a lower boundary of high engine speeds. In turn, the engine oil pressure $EOP_{Est}$ may increase proportionally to the square of the engine speed $RPM_{Est}$ when the engine speed $RPM_{Est}$ is greater than the first predetermined speed and less than the second predetermined speed.

The predetermined ranges may also be based on considerations other than a definable relationship between the engine oil pressure $EOP_{Est}$, the engine speed $RPM_{Est}$, and the engine oil temperature EOT. These considerations may include an ability to detect differences in the engine oil pressure $EOP_{Est}$, lubrication requirements of the engine 102, and a torque change due to cycling the oil pump assembly 105 that may be felt by a driver.

For example, differences in the engine oil pressure $EOP_{Est}$ due to switching the oil pump assembly 105 may be slight and therefore difficult to detect when the engine speed $RPM_{Est}$ is low (e.g., less than 1000 to 1400 rpm). Thus, the state of the oil pump assembly 105 may be difficult to determine based on the engine oil pressure $EOP_{Est}$ when the engine speed $RPM_{Est}$ is low or high. Therefore, the predetermined speed range may be based on an ability to detect differences in the engine oil pressure $EOP_{Est}$ as well as a definable relationship between the engine oil pressure $EOP_{Est}$ and the engine speed $RPM_{Est}$.

In another example, the lubrication requirements of the engine 102 may not be satisfied when the engine speed $RPM_{Est}$ is greater than a maximum allowable speed for the second (low) pressure mode. In turn, the engine 102 may be damaged when the engine speed $RPM_{Est}$ is greater than the maximum allowable speed. To prevent this, the predetermined speed range may be based on the lubrication requirements of the engine 102. For example, the second predetermined speed may be equal to the maximum allowable speed.

In yet another example, cycling the oil pump assembly 105 may cause a torque change due to changes in the displacement of and the pressure rise across the oil pump 205. As the engine speed $RPM_{Est}$ and the engine oil temperature EOT increase, differences in the engine oil pressure $EOP_{Est}$ due to cycling increase. This increases the magnitude of the torque change, which increases the likelihood that a driver will feel the torque change. Thus, the predetermined ranges for the engine speed $RPM_{Est}$ and the engine oil temperature EOT may be based on the likelihood that a driver will feel a torque change caused by cycling.

In the preceding example, a difference of 1 bar in the engine oil pressure $EOP_{Est}$ may cause a torque change of 1 Nm. A driver may feel a torque change greater than 3 Nm. Thus, the predetermined ranges for the engine speed $RPM_{Est}$ and the engine oil temperature EOT may prevent a pressure difference greater than 2 bar. This may prevent a torque change greater than 2 Nm, which may prevent the driver from feeling a torque change due to cycling.

As discussed above, the predetermined ranges for the engine speed $RPM_{Est}$ and the engine oil temperature EOT may be influenced by more than one condition. Under these circumstances, the predetermined ranges may be selected to satisfy multiple conditions. For example, an upper boundary of engine speeds that yield a definable pressure relationship may be less than an upper boundary of engine speeds that yield a detectable pressure difference. In this case, the second predetermined speed may be a minimum of the two upper boundaries so that both of the two preceding conditions are satisfied.

The predetermined ranges for the torque output $ET_{Est}$ may be based on an ability to distinguish differences in the engine oil pressure $EOP_{Est}$ due to cycling from those due to changes in the engine speed $RPM_{Est}$. A large positive or negative torque output $ET_{Est}$ may cause a significant change in the engine speed $RPM_{Est}$. A significant change in the engine speed $RPM_{Est}$ may cause a significant difference in the engine oil pressure $EOP_{Est}$. Significant differences in the engine oil pressure $EOP_{Est}$ due to changes in the engine speed may be difficult to distinguish from differences in the engine oil pressure $EOP_{Est}$ due to cycling. Therefore, the predetermined ranges for the torque output $ET_{Est}$ may be defined to avoid significant changes in the engine speed $RPM_{Est}$.

At 506, the active test module 400 verifies that oil circulating through the engine 102 is not aerated. If 506 is false, the active test module 400 continues at 500. If 506 is true, the active test module 400 continues at 508. Air levels in the oil increase as the engine speed $RPM_{Est}$ increases. In turn, the engine oil pressure $EOP_{Est}$ decreases and the oil loses lubricating capacity. To avoid this, the active test module 400 verifies that the oil is not aerated.

The active test module 400 may determine that the oil is aerated when a first condition is satisfied. The first condition may be satisfied when the engine speed $RPM_{Est}$ is greater than a first predetermined speed for a first predetermined period. For example, the active test module 400 may determine that the oil is aerated when the engine speed $RPM_{Est}$ is greater than 5,000 rpm for 30 seconds.

When the engine speed $RPM_{Est}$ is greater than the maximum speed for the first predetermined period, the active test module 400 may determine that the oil is aerated until a second condition is satisfied. The second condition may be satisfied when the engine speed $RPM_{Est}$ is less than a second predetermined speed for a second predetermined period. For example, the active test module 400 may determine that the oil is no longer aerated when the engine speed $RPM_{Est}$ is less than 3,000 rpm for 60 seconds.

At 508, the active test module 400 determines whether the engine oil temperature EOT and the engine speed $RPM_{Est}$ are stable. If 508 is false, the active test module 400 continues at 500. If 508 is true, the active test module 400 continues at 510. Changes in the engine speed $RPM_{Est}$ and the engine oil temperature EOT may cause changes in the engine oil pressure $EOP_{Est}$ that are difficult to distinguish from those caused by cycling the oil pump assembly 105. To avoid this issue, the active test module 400 ensures that the engine oil temperature EOT and the engine speed $RPM_{Est}$ are stable.

The active test module 400 may determine that the engine oil temperature EOT and the engine speed $RPM_{Est}$ are stable when a third condition is satisfied. The third condition may be satisfied when changes in the engine oil temperature EOT and the engine speed $RPM_{Est}$ over a third predetermined period are less than first predetermined changes. For example, the engine speed $RPM_{Est}$ may be stable when the engine speed RPM does not change more than 50 rpm over a period of 1 second.

At 510, the active test module 400 generates the eighth mode request signal MODE8 to switch the operating mode of the oil pump assembly 105 from the second (low) pressure mode to the first (high) pressure mode. At 512, the active test module 400 determines whether the engine oil temperature EOT and the engine speed $RPM_{Est}$ are stable. If 512 is false, the active test module 400 continues at 514. If 512 is true, the active test module 400 continues at 516.

The active test module 400 may determine that the engine oil temperature EOT and the engine speed $RPM_{Est}$ are stable when a fourth condition is satisfied. The fourth condition may be satisfied when changes in the engine oil temperature EOT and the engine speed $RPM_{Est}$ over a fourth predetermined period are less than second predetermined changes. The fourth predetermined period may start when the operating mode of the oil pump assembly 105 is switched to the first (high) pressure mode. For example, the engine speed $RPM_{Est}$ may be stable when the engine speed RPM changes less than 50 rpm over a 1 second period starting when the operating mode of the oil pump assembly 105 is switched to the first (high) pressure mode.

At 514, the active test module 400 generates the eighth mode request signal MODE8 to switch the operating mode of the oil pump assembly 105 from the first (high) pressure mode to the second (low) pressure mode. The active test module 400 may switch the oil pump assembly 105 to the second (low) pressure mode to enable more switching to the first (high) pressure mode.

At 516, the active test module 400 determines whether a change in the engine oil pressure $EOP_{Est}$ over a fifth predetermined period is less than a minimum pressure change. If 516 is false, the active test module 400 continues at 518. If 516 is true, the active test module 400 continues at 520.

The fifth predetermined period may be a 1-second period that starts when the operating mode of the oil pump assembly 105 is switched to the first (high) pressure mode. The minimum pressure change may be a minimum expected change in the engine oil pressure $EOP_{Est}$ when the oil pump assembly is switched to the first (high) pressure mode. The minimum pressure change may be determined based on the engine speed $RPM_{Est}$ and the engine oil temperature EOT using a lookup table, which may be developed through testing.

The lookup table may be based on a first (high) pressure curve and a second (low) pressure curve representing the engine oil pressure $EOP_{Est}$ as a function of the engine speed $RPM_{Est}$ and the engine oil temperature EOT. The first (high) pressure curve represents the engine oil pressure $EOP_{Est}$ when the oil pump assembly 105 is operating in the first (high) pressure mode. The second (low) pressure curve represents the engine oil pressure $EOP_{Est}$ when the oil pump assembly 105 is operating in the second (low) pressure mode. The minimum pressure change may be the difference between the first (high) pressure curve and the second (low) pressure curve at a given engine speed $RPM_{Est}$ and a given engine oil temperature (EOT). The minimum pressure change may be a product of this difference and a factor (e.g., 0.5).

At 518, the active test module 400 increments a sample counter and continues at 526. The sample counter represents the number of times that the active test module 400 has cycled the oil pump assembly 105 and analyzed the engine oil pressure $EOP_{Est}$. At 520, the active test module 400 determines whether the engine oil pressure $EOP_{Est}$ at the end of the fifth predetermined period is less a minimum pressure. If 520 is false, the active test module 400 continues at 522. If 520 is true, the active test module 400 continues at 524.

The minimum pressure represents a dividing line between the first (high) and second (low) pressure modes of the oil pump assembly 105. The oil pump assembly 105 may be operating in the first (high) pressure mode when the engine oil pressure $EOP_{Est}$ is greater than or equal to the minimum pressure. The oil pump assembly 105 may be operating in the second (low) pressure mode when the engine oil pressure $EOP_{Est}$ is less than the minimum pressure.

At 522, the active test module 400 increments a stuck high counter and continues at 518. The stuck high counter represents the number of times that the oil pump assembly 105 is stuck in the first (high) pressure mode. At 524, the active test module 400 increments a stuck low counter and continues at 518. The stuck low counter represents the number of times that the oil pump assembly 105 is stuck in the second (low) pressure mode. The sample counter, the stuck high counter, and the stuck low counter may be stored in non-volatile memory and may be reset each time that a driver stops or starts the engine 102.

At 526, the active test module 400 determines whether the stuck low counter is less than or equal to a first maximum count. The first maximum count represents a maximum allowable number of times that the oil pump assembly 105 may be stuck in the first (high) pressure mode during the active test. If 526 is false, the active test module 400 continues at 528. If 526 is true, the active test module 400 continues at 530.

At 528, the active test module 400 diagnoses a stuck low pump fault. At this point, the active test module 400 may generate a signal indicating that the oil pump assembly 105 is stuck in the second (low) pressure mode. The active test module 400 may output this signal to other modules in the ECM 104. The ECM 104 may activate a service indicator and/or may adjust operation of the engine 102 to prevent damage to the engine 102 due to insufficient lubrication.

At 530, the active test module 400 determines whether the stuck high counter is less than or equal to a second maximum count. The second maximum count represents a maximum allowable number of times that the oil pump assembly 105 may be stuck in the first (high) pressure mode during the active test. If 530 is false, the active test module 400 continues at 532. If 530 is true, the active test module 400 continues at 534.

At 532, the active test module 400 diagnoses a stuck high pump fault. At this point, the active test module 400 may generate a signal indicating that the oil pump assembly 105 is stuck in the first (high) pressure mode. The active test module 400 may output this signal to other modules in the ECM 104. The ECM 104 may activate a service indicator upon receiving this signal.

At 534, the active test module 400 determines whether the sample counter is greater than a test count. The test count represents a number of times that the active test module 400 cycles the oil pump assembly 105 and analyzes the engine oil pressure $EOP_{Est}$. If 534 is false, the active test module 400 continues at 514. If 534 is true the active test module 400 continues at 536, ends the active test, and initiates the passive test.

The threshold for a stuck low pump fault may be lower than the threshold for a stuck high pump fault since the engine 102 may be damaged when the oil pump assembly 105 is stuck in the second (low) pressure mode. Thus, the first maximum count may be less than the second maximum count.

The first maximum count, the second maximum count, and the test count may be predetermined. The test count may be equal to a sum of the first and second maximum counts. For example, the first maximum count may be 1, the second maximum count may be 3, and the test count may be 4.

The active test module 400 may cycle the oil pump assembly 105 a predetermined number of times each time that a driver starts the engine 102. Since the active test module 400 ends the active test and starts the passive test when the sample counter is greater than the test count, the predetermined number of times may be the lowest integer greater than the test count. For example, when the test count is 4, the active test module 400 may cycle the oil pump assembly 105 five times each time that a driver starts the engine 102.

Figure 7:
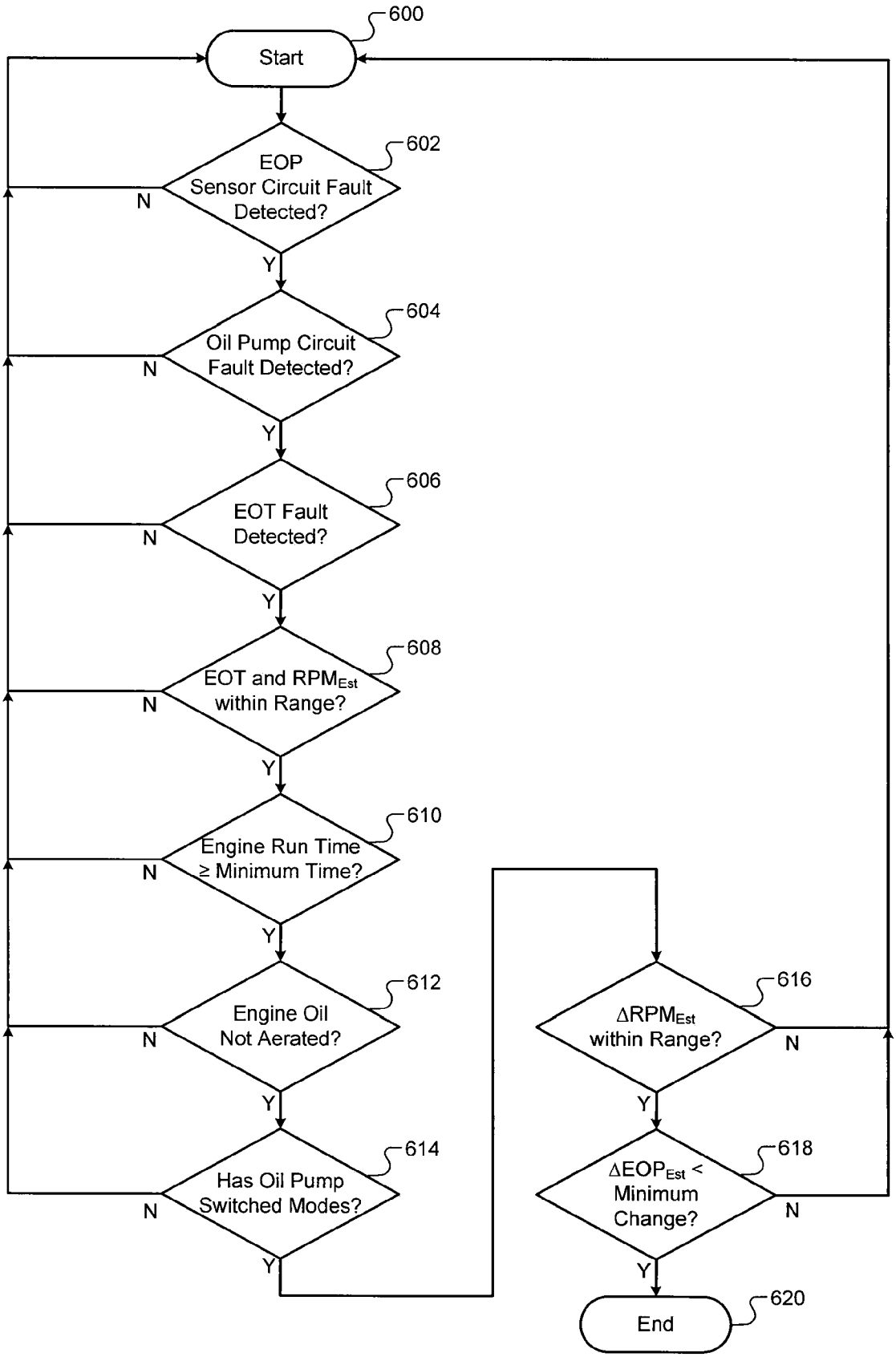

The passive test module 402 begins the passive test at 600 (FIG. 7). At 602, the passive test module 402 determines whether a fault is detected in an EOP sensor circuit containing the EOP sensor 236. Faults detected in the EOP sensor circuit may include a short to a power source, a short to a ground, and/or an open circuit. If 602 is false, the passive test module 402 continues at 600. If 602 is true, the passive test module 402 continues at 604.

At 604, the passive test module 402 determines whether a fault is detected in an oil pump circuit containing the oil pump 205. Faults detected in the oil pump circuit may include a short to a power source, a short to a ground, and/or an open circuit. If 604 is false, the passive test module 402 continues at 600. If 604 is true, the passive test module 402 continues at 606.

At 606, the passive test module 402 determines whether a fault is detected in the engine oil temperature EOT. As discussed above, the engine oil temperature EOT may be determined based on a signal from the EOT sensor 232 and/or based on engine operating conditions and/or ambient conditions. The engine operating conditions may include the engine coolant temperature and the engine run time. The ambient conditions may include an ambient temperature.

When the engine oil temperature EOT is determined based on the EOT sensor 232, faults detected in the engine oil temperature EOT may include a fault detected in an EOT sensor circuit containing the EOT sensor 232. Faults detected in the EOT sensor circuit may include a short to a power source, a short to a ground, and/or an open circuit.

When the engine oil temperature EDT is determined based on engine operating conditions and/or ambient conditions, faults detected in the engine oil temperature EOT may include faults detected in circuits used to detect those conditions. For example, the engine coolant temperature may be detected using an ECT sensor circuit containing the ECT sensor 182. In this case, faults detected in the engine oil temperature EOT may include faults detected in the ECT sensor circuit. Faults detected in the ECT sensor circuit may include a short to a power source, a short to a ground, and/or an open circuit.

At 608, the passive test module determines whether the engine oil temperature EOT and the engine speed $RPM_{ESt}$ are within predetermined ranges. If 608 is false, the passive test module 402 continues at 600. If 608 is true, the passive test module 402 continues at 610.

As with the active test, the predetermined ranges of the passive test may enable identifying the operating mode of the oil pump assembly 105 based on the engine oil pressure $EOP_{Est}$. However, unlike the active test, the passive test does not cycle the oil pump assembly 105 for diagnostic purposes. The passive test monitors operating conditions of the engine 102 and the oil pump assembly 105 as the oil pump assembly 105 is cycled to satisfy engine lubrication and fuel economy requirements rather than for diagnostic purposes. Thus, in contrast to the active test, the predetermined ranges of the passive test may not be defined to ensure that the lubrication requirements of the engine 102 are satisfied and to avoid a torque change that may be felt by a driver.

The predetermined ranges may be determined through testing based on the preceding test consideration. Specifically, testing may be conducted to optimize the predetermined ranges for identifying the operating mode of the oil pump assembly 105 based on the engine oil pressure $EOP_{Est}$.

For example, the predetermined ranges for the engine oil temperature EOT may be defined to ensure that the engine oil pressure $EOP_{Est}$ is linearly related to the engine oil temperature EOT. In another example, the predetermined ranges for the engine speed $RPM_{Est}$ may be defined to ensure that the engine oil pressure $EOP_{Est}$ increases proportionally to a square of the engine speed $RPM_{Est}$.

At 610, the passive test module 402 determines whether the engine run time is greater than a minimum time. If 610 is false, the passive test module 402 continues at 600. If 610 is true, the passive test module 402 continues at 612. The passive test module 402 may receive the engine run time from the engine run time module 264. The minimum time may be predetermined and may allow the engine 102 to stabilize after the engine 102 is started and before the engine oil pressure $EOP_{Est}$ is analyzed during the passive test. For example, the minimum time may be 10 seconds.

At 612, the passive test module 402 verifies that oil circulating through the engine 102 is not aerated. If 612 is false, the passive test module 402 continues at 600. If 612 is true, the passive test module 402 continues at 614. The passive test module 402 may determine whether the oil is aerated using the same criteria used by the active test module 400 to determine whether the oil is aerated. Thus, the passive test module 402 may determine whether the oil is aerated based on the engine speed $RPM_{Est}$ and the time elapsed while the engine speed $RPM_{Est}$ is greater than or less than certain thresholds.

For example, the passive test module 402 may determine that the oil is aerated when the engine speed $RPM_{Est}$ is greater than a first predetermined speed for a first predetermined period. In another example, the passive test module 402 may determine that the oil is no longer aerated when the engine speed $RPM_{Est}$ is less than a second predetermined speed for a second predetermined period.

At 614, the passive test module 402 determines whether the oil pump assembly 105 has switched operating modes. The passive test module 402 may make this determination based on, for example, the solenoid valve control signal generated by the mode selection module 250. In addition, the passive test module 402 may make this determination based on the engine oil pressure $EOP_{Est}$. If 614 is false, the passive test module 402 continues at 600. If 614 is true, the passive test module 402 continues at 616.

At 616, the passive test module 402 determines whether a change in the engine speed $RPM_{Est}$ over a first period is greater than a maximum speed change. If 616 is false, the passive test module 402 continues at 600. If 616 is true, the passive test module 402 continues at 618. The first period may start when the oil pump assembly 105 switches operating modes and may end after a predetermined time (e.g., 1 second) elapses.

Changes in the engine speed $RPM_{Est}$ may cause a change in the engine oil pressure $EOP_{Est}$. For example, a change of 500 rpm in the engine speed $RPM_{Est}$ may cause a change of 0.5 bar in the engine oil pressure $EOP_{Est}$. The passive test module 402 may account for changes in the engine speed $RPM_{Est}$ when identifying the operating mode of the oil pump assembly 105 based on the engine oil pressure $EOP_{Est}$. However, this may be difficult when changes in the engine speed $RPM_{Est}$ are significant. Therefore, the passive test module 402 confirms that changes in the engine speed $RPM_{Est}$ are less than the maximum speed change before analyzing the engine oil pressure $EOP_{Est}$.

At 618, the passive test module 402 determines whether a change in the engine oil pressure $EOP_{Est}$ over a second period is less than a minimum pressure change. If 618 is false, the passive test module 402 continues at 600. If 618 is true, the passive test module 402 continues at 620. The second period may start when the oil pump assembly 105 switches operating modes and may end after a predetermined time elapses. The second predetermined period may be the same as or different from the first predetermined period.

The minimum pressure change may be a minimum expected change in the engine oil pressure $EOP_{Est}$ when the oil pump assembly is switched to the first (high) pressure mode. The minimum pressure change may be determined based on the engine speed $RPM_{Est}$ and the engine oil temperature EOT using a lookup table that is developed through testing. The same lookup table may be used in the active and passive tests for determining the minimum pressure change.

At 620, the passive test module 402 ends the passive test and initiates the active test. In turn, the active test module 400 continues at 500. The passive test module 402 may initiate the active test rather than diagnose a pump fault because the active test may diagnose pump faults more accurately. However, by initiating the active test when the engine oil pressure $EOP_{Est}$ does not change as expected, the passive test enables identification of failures in the oil pump assembly 105 occurring after the active test has been executed.

Figure 8:
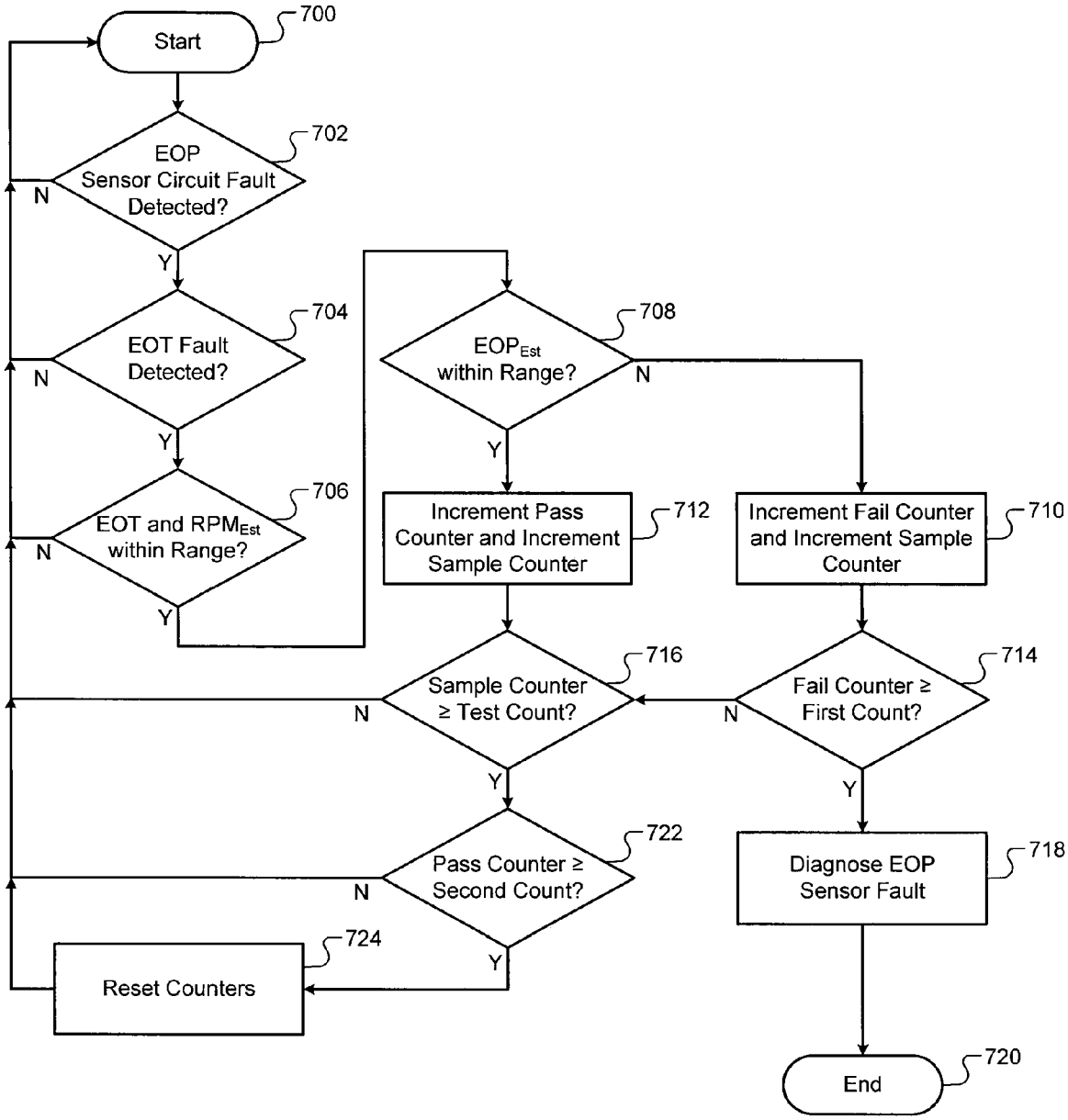

The sensor test module 404 begins an engine-on sensor test at 700 (FIG. 8). The engine-on sensor test is a test of the EOP sensor 236 when the engine 102 is on. The active and passive tests diagnose pump faults based on the engine oil pressure $EOP_{Est}$, which is determined based on the oil pressure signal $EOP_{Sensor}$ from the EOP sensor 236. The engine-on sensor test verifies that the engine oil pressure $EOP_{Est}$ is accurate, preventing false diagnoses of pump faults. This test may not be executed when the ambient temperature is less than a predetermined temperature, such as −7 degrees Celsius (° C.).

At 702, the sensor test module 404 determines whether a fault is detected in an EOP sensor circuit containing the EOP sensor 236. Faults detected in the EOP sensor circuit may include a short to a power source, a short to a ground, and/or an open circuit. If 702 is false, the sensor test module 404 continues at 700. If 702 is true, the sensor test module 404 continues at 704.

At 704, the sensor test module 404 determines whether a fault is detected in the engine oil temperature EOT. The sensor test module 404 may use the same criteria used by the passive test module 402 to determine whether a fault is detected in the engine oil temperature EOT. Thus, faults detected in the engine oil temperature EOT may include a short to a power source, a short to a ground, and/or an open circuit detected in circuits used to determine the engine oil temperature EOT either directly or indirectly. These circuits may include an EOT circuit containing the EDT sensor 232, an ECT circuit containing the ECT sensor 182, and/or an IAT circuit containing the IAT sensor 192.

At 706, the sensor test module 404 determines whether the engine oil temperature EOT and the engine speed $RPM_{Est}$ are within predetermined ranges. If 706 is false, the sensor test module 404 continues at 700. If 706 is true, the sensor test module 404 continues at 708.

The sensor test module 404 may use the same criteria used by the passive test module 402 to determine whether the engine oil temperature EOT and the engine speed $RPM_{Est}$ are within predetermined ranges. Thus, the predetermined ranges may be defined to yield a predetermined relationship between the engine oil pressure $EOP_{Est}$ and the engine speed $RPM_{Est}$ or the engine oil temperature EOT.

For example, the predetermined range for the engine oil temperature EOT may be defined to ensure that the engine oil pressure $EOP_{Est}$ is linearly related to the engine oil temperature EOT, and may be between 40° C. and 120° C. In another example, the predetermined range for the engine speed $RPM_{Est}$ may be defined to ensure that the engine oil pressure $EOP_{Est}$ increases proportionally to a square of the engine speed $RPM_{Est}$.

At 708, the sensor test module 404 determines whether the engine oil pressure $EOP_{Est}$ is within a pressure range. If 708 is false, the sensor test module 404 continues at 710. If 708 is true, the sensor test module 404 continues at 712. The pressure range may be determined based on the engine speed $RPM_{Est}$ and the engine oil pressure EOT by, for example, using a lookup table. The lookup table may be developed through laboratory or vehicle testing.

The pressure range may be defined by a lower limit and an upper limit. The lower limit may be based on a minimum pressure required to adequately lubricate the engine 102. The upper limit may be based on a high pressure curve representing the engine oil pressure $EOP_{Est}$ as a function of the engine speed $RPM_{Est}$ and the engine oil temperature EOT. The upper limit may be the engine oil pressure $EOP_{Est}$ at a point on the high pressure curve corresponding to a given engine speed $RPM_{Est}$ and a given engine oil temperature EOT. The upper limit may be equal to the engine oil pressure $EOP_{Est}$ at this point multiplied by a factor and added to an offset.

At 710, the sensor test module 404 increments a fail counter, increments a sample counter, and continues at 714. The fail counter represents the number of times that the engine oil pressure $EOP_{Est}$ is determined to be outside of the expected pressure range. The sample counter represents the total number of times that the engine oil pressure $EOP_{Est}$ has been analyzed during the engine-on sensor test.

At 714, the sensor test module 404 determines whether the fail counter is greater than or equal to a first predetermined count (e.g., 40). If 714 is false, the sensor test module 404 continues at 716. If 714 is true, the sensor test module 404 continues at 718 and diagnoses an engine-on sensor fault. The engine-on sensor test ends at 720.

At 712, the sensor test module 404 increments a pass counter, increments the sample counter, and continues at 716. The pass counter represents the number of times that the engine oil pressure $EOP_{Est}$ is determined to be within the expected pressure range. At 716, the sensor test module 404 determines whether the sample counter is greater than or equal to a predetermined test count (e.g., 50). If 716 is false, the sensor test module 404 continues at 700. If 716 is true, the sensor test module 404 continues at 722.

At 722, the sensor test module 404 determines whether the pass counter is greater than or equal to a second predetermined count (e.g., 40). If 722 is false, the sensor test module 404 continues at 700. If 722 is true, the sensor test module 404 resets the counters at 724 and then continues at 700.

Figure 9:
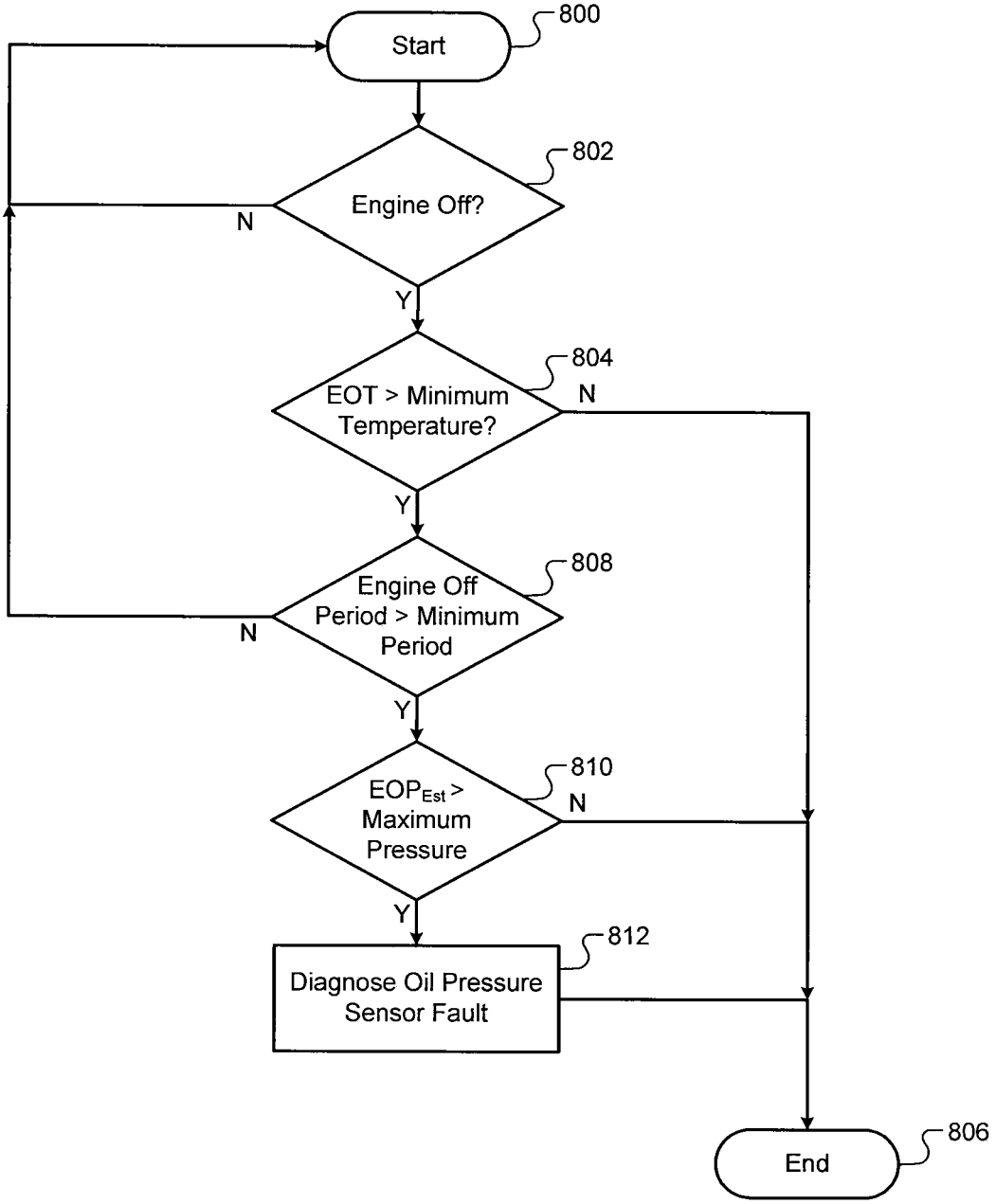

The sensor test module 404 begins an engine-off sensor test at 800 (FIG. 9). The engine-off sensor test is a test of the EOP sensor 236 when the engine 102 is off. The active test diagnoses faults in the oil pump assembly 105 upon engine startup based on the engine oil pressure $EOP_{Est}$, which is determined based on the oil pressure signal $EOP_{sensor}$ from the EOP sensor 236. The engine-off sensor test ensures that the oil pressure signal $EOP_{sensor}$ is not stuck in range when the engine 102 is shutoff, preventing false diagnoses of pump faults when the engine is started.

At 802, the sensor test module 404 determines whether the engine 102 has been shutoff. The sensor test module 404 may make this determination based on, for example, the engine speed $RPM_{Est}$, a crank signal of the engine CRANK, and/or an ignition signal of the engine 102. For example, the sensor test module 404 may determine that the engine 102 has been shutoff when the engine speed $RPM_{Est}$ is 0 rpm or less than a predetermined speed.

At 804, the sensor test module 404 determines whether the engine oil temperature EOT is greater than a minimum temperature. The sensor test module 404 may make this determination to ensure that decreases in the engine oil pressure $EOP_{Est}$ after the engine 102 is shutoff may be measured and compared to expected decreases. If 804 is false, the sensor test module 404 continues at 806. If 804 is true, the sensor test module 404 continues at 808. The engine-off sensor test ends at 806.

At 808, the sensor test module 404 determines whether the engine off period is greater than a minimum period. The engine off period starts when the engine 102 is shutoff and continues until the engine 102 is started. The minimum period may be predetermined and may ensure that decreases in the engine oil pressure $EOP_{Est}$ after the engine 102 is shutoff may be measured and compared to expected decreases. If 808 is false, the sensor test module 404 continues at 800. If 808 is true, the sensor test module 404 continues at 810.

At 810, the sensor test module 404 determines whether the engine oil pressure $EOP_{Est}$ is greater than a maximum pressure. If 810 is false, the sensor test module 404 continues at 806. If 810 is true, the sensor test module 404 continues at 812 and diagnoses an engine-off sensor fault. When the EOP sensor 236 is operating as expected, the engine oil pressure $EOP_{Est}$ will be less than or equal to the maximum pressure after the engine 102 is shutdown and the minimum period has elapsed. When the EOP sensor 236 is not operating as expected, the engine oil pressure $EOP_{Est}$ will be greater than the maximum pressure after the engine 102 is shutdown and the minimum period has elapsed. The maximum pressure may be predetermined through testing.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A control system, comprising:

an oil pump module that, based on operating conditions of an engine, selectively generates a first mode request signal to initiate a first transition from operating an oil pump of the engine in one of a first pressure mode and a second pressure mode to operating the oil pump in another one of the first pressure mode and the second pressure mode; and a diagnostic module that, based on when a driver starts the engine, selectively generates a second mode request signal to initiate consecutive transitions from operating the oil pump in the second pressure mode to operating the oil pump in the first pressure mode, wherein the second pressure mode is different from the first pressure mode and the diagnostic module diagnoses a pump fault when a first oil pressure change associated with the consecutive transitions is less than a first predetermined pressure change.

2. The control system of claim 1, further comprising a mode selection module that selectively operates the oil pump in the first pressure mode and in the second pressure mode based on the first mode request signal and the second mode request signal.

3. The control system of claim 1, wherein the diagnostic module selectively determines that the oil pump is stuck in one of the first pressure mode and the second pressure mode based on an engine oil pressure after each of the consecutive transitions.

4. The control system of claim 3, further comprising:

an oil pressure sensor detecting the engine oil pressure; and a sensor test module that diagnoses a sensor fault when the engine oil pressure is outside of a predetermined pressure range.

5. The control system of claim 1, further comprising an active test module that selectively cycles the oil pump a predetermined number of times when the driver starts the engine.

6. The control system of claim 5, wherein the active test module selectively cycles the oil pump when an engine oil temperature, an engine speed, and an engine torque are within predetermined engine operating ranges.

7. The control system of claim 6, wherein the active test module refrains from cycling the oil pump when the engine speed is greater than a predetermined speed for a first predetermined period.

8. The control system of claim 6, wherein the active test module cycles the oil pump when changes in the engine speed and in the engine torque during a second predetermined period are less than predetermined engine operating changes.

9. The control system of claim 6, further comprising a passive test module that selectively evaluates a second oil pressure change associated with the first transition based on the engine oil temperature and the engine speed.

10. The control system of claim 9, wherein the passive test module initiates an active test of the oil pump when the second oil pressure change is less than a second predetermined pressure change, wherein the active test module cycles the oil pump when the active test is initiated.

11. A method, comprising:

selectively generating a first mode request signal based on operating conditions of an engine to initiate a first transition from operating an oil pump of the engine in one of a first pressure mode and a second pressure mode to operating the oil pump in another one of the first pressure mode and the second pressure mode;

selectively generating a second mode request signal based on when a driver starts the engine to initiate consecutive transitions from operating the oil pump in the second pressure mode to operating the oil pump in the first pressure mode; and diagnosing a pump fault when a first oil pressure change associated with the consecutive transitions is less than a first predetermined pressure change, wherein the second pressure mode is different from the first pressure mode.

12. The method of claim 11, further comprising selectively operating the oil pump in the first pressure mode and in the second pressure mode based on the first mode request signal and the second mode request signal.

13. The method of claim 11, further comprising selectively determining that the oil pump is stuck in one of the first pressure mode and the second pressure mode based on an engine oil pressure after each of the consecutive transitions.

14. The method of claim 13, further comprising:

detecting the engine oil pressure; and diagnosing a sensor fault when the engine oil pressure is outside of a predetermined pressure range.

15. The method of claim 11, further comprising selectively cycling the oil pump a predetermined number of times when the driver starts the engine.

16. The method of claim 15, further comprising selectively cycling the oil pump when an engine oil temperature, an engine speed, and an engine torque are within predetermined engine operating ranges.

17. The method of claim 16, further comprising refraining from cycling the oil pump when the engine speed is greater than a predetermined speed for a first predetermined period.

18. The method of claim 16, further comprising cycling the oil pump when changes in the engine speed and in the engine torque during a second predetermined period are less than predetermined engine operating changes.

19. The method of claim 16, further comprising selectively evaluating a second oil pressure change associated with the first transition based on the engine oil temperature and the engine speed.

20. The method of claim 19, further comprising:

initiating an active test of the oil pump when the second oil pressure change is less than a second predetermined pressure change; and cycling the oil pump when the active test is initiated.

* * * * *